United States Patent [19]

Bouffard et al.

[11] Patent Number: 4,590,754

[45] Date of Patent: May 27, 1986

[54] FORMING CABLE CORE UNITS

[75] Inventors: Jean Bouffard, Lachine; André Dumoulin, Montagnes; Marc Séguin, Ile Perrot, all of Canada

[73] Assignee: Northern Telecom Limited, Montreal, Canada

[21] Appl. No.: 565,634

[22] Filed: Dec. 27, 1983

[51] Int. Cl.[4] ..... D01H 1/04; D01H 1/10; D01H 7/86; D01H 13/10

[52] U.S. Cl. ..... 57/58.55; 57/58.7; 57/58.86; 57/68; 57/314; 464/30

[58] Field of Search ..... 57/14, 58.3, 58.32, 57/58.34, 58.36, 58.38, 58.55, 58.54, 58.52, 58.7, 59–65, 67, 68, 314; 226/188, 194; 464/42, 40, 178, 30

[56] References Cited

U.S. PATENT DOCUMENTS

| | | | |
|---|---|---|---|
| 2,921,429 | 1/1960 | Haugwitz | 57/58.52 |
| 2,923,140 | 2/1960 | Weasler | 464/178 X |
| 3,093,330 | 6/1963 | Schmidt | 242/45 |
| 3,099,126 | 7/1963 | Laureti | 57/58.83 X |
| 3,138,914 | 6/1964 | Blaisdell | 57/58.7 |
| 3,147,580 | 9/1964 | Blaisdell et al. | 57/58.52 X |
| 3,828,538 | 8/1974 | Yoshida et al. | 57/58.54 |

FOREIGN PATENT DOCUMENTS 1428130 3/1976 United Kingdom .

*Primary Examiner*—Stuart S. Levy
*Assistant Examiner*—Joseph J. Hail, III
*Attorney, Agent, or Firm*—R. J. Austin

[57] ABSTRACT

Making a cable core unit in which pairs of twisted conductors are formed upon individual twisting machines, the twisted conductor pairs then fed 'in-line' to a core forming device by passing the pairs through a tension reducing means which reduces tension in each pair while allowing the lengths of the pairs to be different from pair-to-pair as they move into the core forming device. Built-in tensions and twisted core units are thus avoided. Also provided is a tension equalizing device which averages out the tensions between conductor pairs.

5 Claims, 7 Drawing Figures

FIG. 1
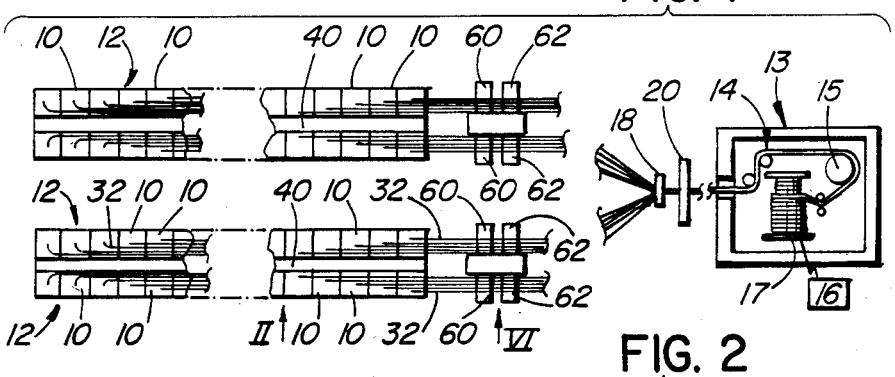
FIG. 2
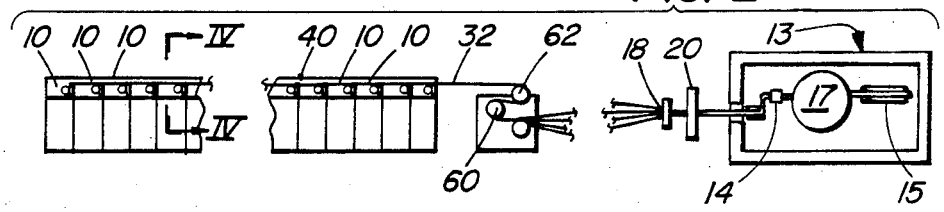
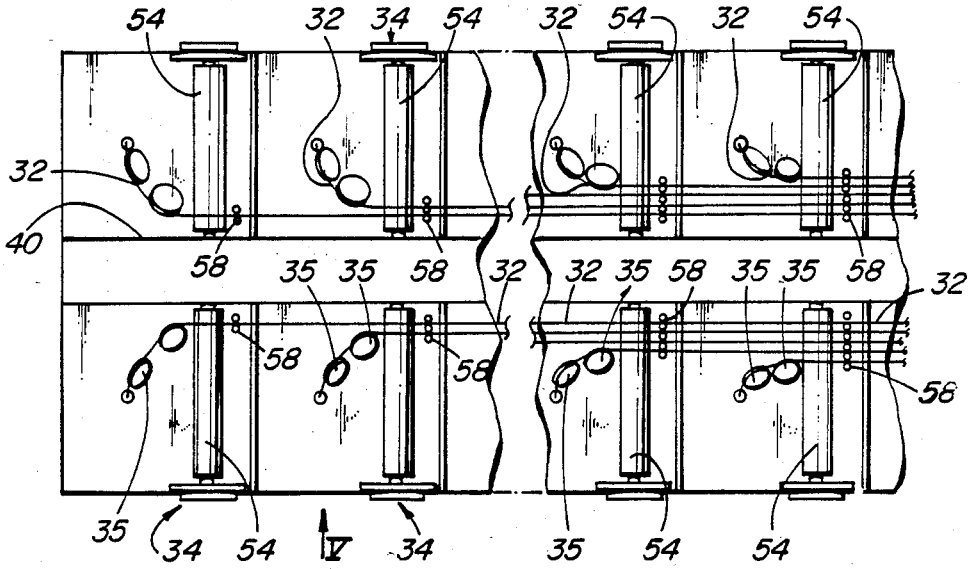
FIG. 3

FORMING CABLE CORE UNITS

This invention relates to the forming of cable core units.

It is known that the twisting of insulated electrical conductors together to form twisted conductor units with a single direction of twist offers physical and electrical advantages when used in telecommunications cable cores. For example, the provision of twisted conductor units improves electrical characteristics such as a reduction in crosstalk. Normally a twisted conductor unit consists of two insulated conductors twisted together as a twisted pair.

Conventionally, to twist conductors together in twisted pairs, high speed twisting machines are used. In such twisting machines, two lengths of insulated conductors are held upon reels which are freely rotatably mounted upon reel shafts in a reel cable. To twist the conductor lengths together, each length is fed from its reel, around a rotatable pulley system and the lengths are then brought into side-by-side positions in which they are caused to rotate by means of a flyer or other framework, around an axis of the cradle. This rotation provides a double twist in the conductors and thus forms the twisted pair. The twisted pair is wound onto another reel immediately after twisting. After winding, this reel is removed from the twisting machine and subsequently placed with other reels of twisted pairs as supply to a machine to draw the twisted pairs together to form a core unit. The twisted pairs are then drawn through the core unit forming machine to provide a core unit of a plurality of pairs, e.g. 50 or 100 pairs. Hence, twisting into pairs is performed as a separate operation and on a different machine from the core unit forming machine.

While it may be a manufacturing aim to twist the conductors into twisted pairs in tandem with the core unit forming operation, this is extremely difficult to achieve in practice for the following reasons. During forming into core units, problems are found in drawing twisted conductor pairs under substantially equal tensions into the core unit forming machine when a tandem operation is followed at high line speeds, e.g. in excess of 400 ft./minute.

This is because the tensions induced into each twisted pair as it is drawn into the core unit forming machine depend partly upon the distance between the twisting head and the forming machine and upon the amount of contact between the conductors and machine surfaces. Thus with present knowledge, one theoretical way of reducing tension differences would be to position all of the twisting heads at substantially equal distances from the core unit forming machine. This is impractical, or even impossible, when it is considered that cable core units may include up to 100 twisted pairs of conductors. Design and floor space considerations do not enable 100 twisting machines to be located at substantially equal distances from the core unit forming machine. On the other hand, the largely differing unequal tensions between twisted pairs achieved with differently spaced twisting machines in a tandem operation would result in great tension differences between twisted pairs after forming into core units. In an attempt to relieve these tensions, the core units would become uncontrollably contorted along their lengths. Further processing of the units, e.g. to provide cable sheathing and jacketing, would present insurmountable problems as the core units would need to be non-contorted for these operations. In addition, the differing tensions between the twisted pairs in the cable cause tightening together of the conductors in some regions of the cable more than in others thus varying the spacing between the conductors. This effects variations in mutual capacitance which is extremely undesirable in cable design.

In United Kingdom Pat. No. 1,428,130, there is a description of apparatus for twisting conductor pairs and for stranding cable core units in a tandem operation. In this particular apparatus, twisting machines are arranged in banks extending away from a stranding machine and conductors are fed from these banks into the stranding machines. There is no discussion in this prior specification concerning the difficulties associated with different tensions or tension build-up in the twisted pairs as they approach the stranding machine. Possibly the reason for this omission is that as tension build-up increases with operational speed and as this apparatus is built to operate at extremely low line speeds, e.g. up to 220 ft./min., the problem of tension in the twisted pairs is not sufficiently important to significantly affect the finished product or its electrical performance.

This particular apparatus could not nullify any tension differential effect between twisted pairs nor could it solve the problem of excessive tension build-up in pairs approaching the stranding machine in manufacture of a core unit at faster speeds, e.g. at around 600 ft./min.

In a further construction suggested in U.S. patent application Ser. No. 413,176, filed Aug. 30, 1982, in the name of J. N. Garner et al and entitled "Forming Cable Core Units" now U.S. Pat. No. 4,429,520, there is described an apparatus for tandemizing the twisting and stranding operation. With this arrangement, the twisting operation is performed by oscillating a guide means, which may be in the form of tubes, to provide twisted pairs of conductors. This apparatus, however, will only provide twisted pairs with alternating twist, i.e. with the twist extending first in one direction around the pair and then in the other. This structure is sometimes referred to as an 'S-Z' twist. This type of twist is relatively unknown in cable design and its use in large multi-pair cables has yet to be evaluated together with any attendant difficulties which may at present be unknown. It is known, however, that there would be difficulty in controlling the pitch of the twist in 'S-Z' twist cables and the tensions in the twisted pairs. Varying tensions may have undesirable effects upon the electrical characteristics of the cable and excessive tensions could damage fragile conductor insulation. There are also potential mechanical problems involved. With the use of a continuous direction of twist in each pair, however, the pairs are potentially easier to handle.

The present invention is concerned with an apparatus for tandemizing the operation of twisting units, e.g., pairs of conductors with a continuous twist in one direction and then for forming a core unit while avoiding or minimizing the problems discussed above regarding the build-up of tension in the twisted pairs and the tension differences for high speed operation.

Accordingly, the present invention provides an apparatus for making a core unit of twisted units of individually insulated conductors comprising:

a plurality of twisting machines each for carrying a plurality of reels of insulated conductors and for twisting the conductors together to form a twisted unit;

a core unit forming and take-up means to draw the twisted conductor units together to form a core unit;

drawing means to draw twisted units into the forming and take-up means;

and along feedpaths between the twisting machines and the core unit forming and take-up means, there is provided a tension reducing means comprising rotatable members, and drive means controlled to drive the rotatable members, said drive means dependent upon the drive speed of the drawing means to ensure that the unrestrained peripheral speed of the rotatable members is in excess of the draw speed of the twisted units into the forming and take-up means, lengths of peripheral surfaces of the rotatable members presented to the feedpaths being insufficient to impart a driven speed to the conductors above that of the draw speed into the forming and take-up means.

The core unit forming and take-up means may comprise a stranding machine or a machine which merely groups the twisted units together without stranding.

According to a further aspect, the invention provides apparatus for making a core unit from twisted units of individually insulated conductors comprising:

a plurality of twisting machines each for carrying a plurality of reels of insulated conductor and for twisting the conductors together to form a twisted unit;

a core unit forming and take-up means in tandem with the twisting machines to draw the twisted conductor units together to form a core unit; the forming and take-up means comprising drawing means to draw twisted units into the forming and take-up means; and between each twisting machine and the forming and take-up means, there is provided a tension equalizing means comprising a rotatable member disposed along the feedpaths of the twisted units, and drive means controlled to drive the rotatable member, said drive means having a drive speed dependent upon the drive speed of the drawing means to ensure that the unrestrained peripheral speed of the rotatable member is in excess of the draw speed of the twisted units into the forming and take-up means, lengths of the peripheral surface of the rotatable member presented to the feedpaths being insufficient to impart a driven speed to the twisted units above that of the draw speed into the forming and take-up means.

In a preferred arrangement, the tension equalizing means comprises rotatable members comprising drivable shafts surrounded by tubular members which are in slipping drivable engagement therewith. To provide the slipping drivable engagement, the tubular members may be held in bearings upon the drivable shaft. In this construction it is intended that the unrestrained peripheral speed of the tubular members should exceed the draw speed of the unit into the forming and take-up means. For this purpose, it may be necessary to provide packed grease between the shafts and tubular members to increase the drive between them. The tension equalizing means operates so that as twisted pairs of conductors travel side-by-side across and in contact with the tubular members, the rotational speeds of the tubular members are lessened compared to their unrestrained speeds and these lessened speeds are governed by a combination of tensions and speeds in all of the conductor pairs passing over the members.

To enable the equalizing means to operate, it is essential to place the twisting machines in series so that the feedpaths for the twisted pairs lie side-by-side and the tension equalizing means lies in the paths of the twisted pairs as they approach the forming and take-up means.

The invention further includes a method of forming a core unit of twisted insulated conductor units comprising twisting insulated conductors together into a plurality of twisted insulated conductor units with each unit having a single direction of twist along its length; drawing the twisted units as they are being formed, through a core unit forming and take-up means to form the core unit; and, as the twisted units approach the forming and take-up means, reducing the tension in all of the units by contacting them with a peripheral surface of at least one rotating member disposed in a tension reducing station and driven at a peripheral speed in excess of the draw speed into the forming and take-up means while the draw speed applies tension to the units as they leave the tension reducing station, peripheral surface contact with each unit in the tension reducing station sufficient only to increase the speed of the units toward, but not beyond, that of the draw speed.

The invention also includes a method of forming a core unit of twisted insulated conductor units comprising:

twisting insulated conductors together into a plurality of twisted insulated conductor units with each unit having a single direction of twist along its length;

drawing the twisted units as they are being formed through a core unit forming and take-up means to form the core unit;

and, as the twisted units approach the forming and take-up means, reducing differences in tension between the units by contacting them with the peripheral surface of a rotating member to reduce its peripheral speed to a speed influenced by a combination of tensions in all of the units upstream of the rotatable member.

One embodiment of the invention will now be described by way of example, with reference to the accompanying drawings in which:

FIG. 1 is a plan view of main parts of apparatus for forming a stranded core unit of 100 twisted insulated conductor pairs;

FIG. 2 is a side elevational view of the apparatus of FIG. 1 in the direction of Arrow 'II' in FIG. 1;

FIG. 3 is a plan view of twisting machines and tension equalizing means forming part of the apparatus and shown on a larger scale than in FIG. 1;

Figure 4:
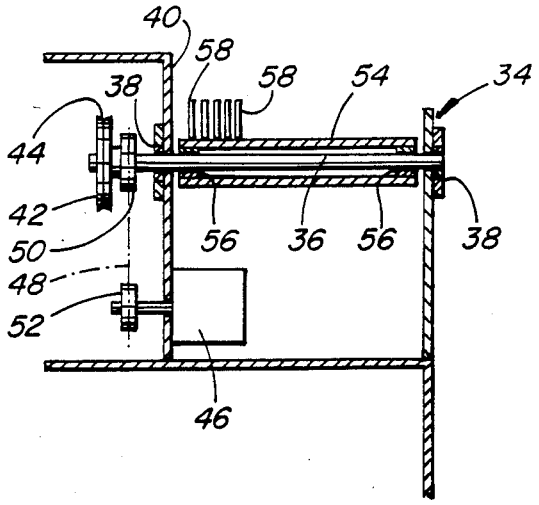
FIG. 4 is a cross-sectional view along line 'IV—IV' in FIG. 2, of a tension equalizing means and on the same scale as FIG. 3.

As shown in FIGS. 1 and 2, apparatus for making a stranded core unit of 100 twisted pairs of conductors comprises apparatus for twisting the conductor pairs including a hundred twisting machines 10 arranged in four straight banks 12 with twenty-five machines in each bank. The apparatus is capable of making cable core unit at a speed of up to and possibly in excess of 600 ft./min. Spaced from one end of the four banks 12 is located a core unit forming and take-up means. This comprises a stranding machine 13 comprising a stranding flyer 14 and including a "helper" capstan 15. The "helper" capstan is to assist in the drawing of the core unit into the machine 13, the main force for which is taken by a motor 16 which drives a core unit take-up reel 17. Upstream of the machine 13 is a drawing means in the form of a closing die 18 for drawing twisted conductor pairs together, and a binding head 20. This structure of closing die, binding head and stranding machine is conventional.

Figure 5:
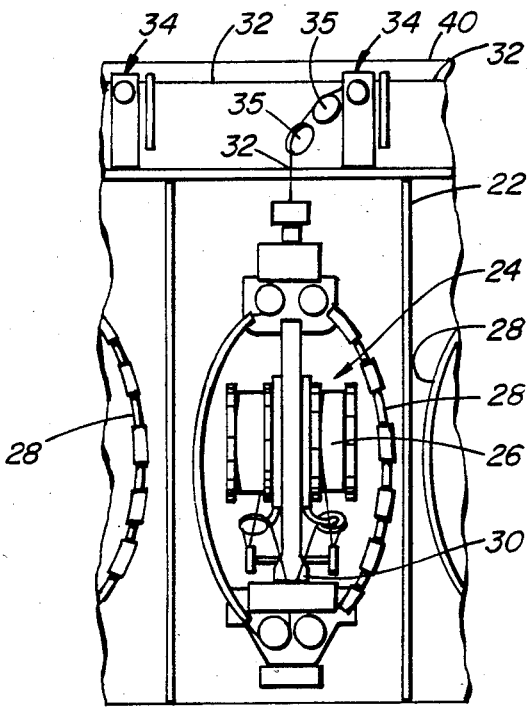
FIG. 5 is a side elevational view of a twisting machine and tension equalizing means taken in the direction of arrow 'V' in FIG. 3.

As shown by FIG. 5, each of the twisting machines 10 comprises a cabinet 22 within which is located a reel cradle 24 for holding two reels 26 of individual insulated conductors in a rotatable fashion to enable the conductors to be drawn from the reels under the drawing influence of the stranding machine 14. Each twisting machine may be of conventional construction for enabling the conductors to be drawn from the reels and to be twisted together as they pass through and outwardly from the machine. However, in this embodiment, each twisting machine is of the construction described in a copending patent application entitled "Twisting Machine" Ser. No. 565,635 now abandoned, filed concurrently with this application and in the names of J. Bouffard, A. Dumoulin and E. D. Lederhose. As shown in that construction each twisting machine comprises two flyers 28 and associated pulleys to provide a balanced rotational structure while avoiding conventional balancing weights. The two conductors 30 being removed from the reels 26 pass downwardly together as described in the aforementioned specification and then through a selected one of the flyers 28 only. As the conductors move through their flyer, the flyers are rotated by a drive motor (not shown) which is either an individual motor for each twisting machine or the twisting machines are driven from a common motor or motors. Flyer rotation causes the two conductors 30 to twist together with a double twist as is known. Each twisting machine forms a sub-assembly on a main frame which extends lengthwise of its bank 12. As described in greater detail in a copending application Ser. No. 565,760 now abandoned filed concurrently with this application, entitled "Apparatus For Twisting Insulated Conductors", and in the names of J. Bouffard, A. Dumoulin and O. Axiuk, each sub-assembly of twisting machine is detachable from the apparatus in a complete form.

As can be seen from FIGS. 1 and 2 particularly, each of the twisted pairs 32 as it emerges from the top of its twisting machine moves along the line of its associated bank 12 of twisting machines as it proceeds towards the stranding machine.

Disposed above each of the units 12 are a plurality of tension equalizing means 34, one above the downstream end of each twisting machine 10. The equalizing means are omitted from FIG. 1 for clarity. FIG. 4 shows one of the tension equalizing means in detail. Each tension equalizing means comprises a shaft 36 which extends from side-to-side of the feedpaths for the twisted pairs, the shaft being held rotatably in bearings 38. One end of each shaft 36 extends through a bearing 38 into the interior of a housing 40, upstanding from the general level of the twisting machines. This end of each shaft 36 has a V-grooved pulley 42 which is engaged by a drive belt 44. The tension equalizing means are driven conveniently in groups of five whereby each of the belts 44 extends along the twisting machines so as to encompass five of the pulleys 42. One of the drive shafts for each of the groups of five is driven directly by a drive motor 46, mounted upon the housing 40 and connected to its drive shaft 36 by an endless drive member 48 and pulleys 50 and 52 located on the drive shaft 36 and on the driven shaft for the motor 46. In each tension equalizing means there is provided a tubular member 54 carried in bearings 56 around shaft 36 so that it is in slipping drivable engagement with the shaft. The tubular member 54 surrounds the shaft 36 so as to extend beneath the feedpaths for twisted pairs of conductors. It is intended that as the shaft 36 is driven then the tubular member 54 will rotate at substantially the same angular speed as the shaft unless the member is restrained. While the bearings 56 may suffice for this purpose, the inside of the tubular member may also be packed with grease to hold it in more positive driving engagement with the shaft.

It is an important aspect of the invention and as brought out in this embodiment that the drive motor 46 is coupled electrically to the line speed of the assembled twisted conductor units into the stranding machine, whereby the speed of the drive motor 46 is controlled in relation to the motor 64 so that the tension equalizing means is driven to provide a peripheral speed for the unrestrained tubular members 54, which is slightly in excess of the draw speed of the twisted pairs into the stranding machine. The line speed of the assembled conductors is measured by a conventional means such as a rotor pulser device (not shown). The reason for this excess speed will be explained below. The peripheral speed of the unrestrained tubular members is a question of choice dependent upon the tension reducing effects that are required. It has been found in practice that the peripheral speed of the tubular members 54 should exceed the speed of the twisted units into the stranding machine by up to 5% and preferably between 2% and 3%.

As may be seen from the above description, there are twenty-five tension equalizing means along each bank 12 of twisting machines. The furthest equalizing means from the stranding machine supports only one twisted pair 32, i.e. that from the furthest twisting machine. The number of twisted pairs supported by equalizing means increases along each bank 12, from equalizing means to equalizing means, until twenty-five pairs are carried by the equalizing means closest to the stranding machine.

Guide means is provided along the twisting machines 10 for holding the twisted pairs 32 spaced from one another to prevent the tension in one pair from influencing that in another. This guide means takes the form of a plurality of vertical guide rods 58. These guide rods are located adjacent to but slightly downstream from each of the tubular members 54 and are held stationary in support brackets (not shown) in spaced apart positions axially of the tubular members. The number of guide rods 58 used in respect of each equalizing means depends on the number of twisted pairs of conductors which will pass over that particular equalizing means. At the equalizing means, at FIG. 4, there are five guide rods 58 provided which thus form guide means for four twisted pairs of conductors.

As the twenty-five twisted pairs of conductors emerge from the downstream end of each of the units 12, they pass through a tension reducing means for the purpose of reducing the tension which has accumulated in the twisted pairs during twisting and drawing of the pairs up to this position. As shown in FIGS. 1, 2, 6 and 7, the tension reducing means for each group of twenty-five twisted pairs of conductors, is in a tension reducing station and comprises two driven rotatable cylinders 60 and 62 around each of which the conductors must pass on the way to the stranding machine. The two cylinders are of substantially equal diameter and have a common drive in the form of a drive motor 64, which is connected to the cylinder 62 by a drive belt 66. A drive belt (not shown) also drivably connects the two cylinders together. The drive motor 64 is electrically influenced by the linespeed also to provide a peripheral speed to each of the cylinders 60 and 62, which is slightly in excess of the drawing speed of the twisted pairs of conductors into the stranding machine. The degree of this excess in speed is again subject to choice dependent upon design, but in this particular machine lies between 1 and 5% and preferably is in the region of 3%.

For purposes of clarity and to assist in an understanding of the operation of each tension reducing means, it is of importance to realize that the two cylinders 60 and 62 are not a capstan drive and do not operate as such in the accepted sense for drawing twisted pairs of conductors through apparatus in cable manufacture. In this embodiment and according to the invention, the cylinders 60 and 62 do not engage each of the twisted pairs along a sufficiently long arc of contact to provide enough frictional grip to draw the pairs from the twisting machines without the assistance of tension upon the pairs downstream of the cylinders and provided by the rotation of the reel 18. Hence, if the stranding machine were omitted, th cylinders 60 and 62 would be incapable of drawing twisted pairs from the twisting machines. Additional frictional grip by the cylinders upon the twisted pairs is created by tension downstream of the cylinders pulling the pairs down onto the cylinder surfaces. While this tension is maintained, the cylinders will draw the twisted pairs from the twisting machine with some slippage because of the excess peripheral speed of the cylinders.

If the grip of the cylinders tends to increase the speed of any pair, in the reducing station, toward its draw speed into the stranding machine, then the downstream tension from the cylinders decreases and the frictional grip of the pair around the cylinders is lessened. Thus the cylinders slip to a greater extent upon the twisted pair and there is a decrease in the tendency for further increase in speed of the pair, as caused by the drive of the cylinders. In any event, because the downstream tension from the cylinders would drop to zero, it is extremely unlikely that the cylinders could drive any twisted pair through the reducing station at a speed equal to the draw speed of the stranding machine. Certainly, the twisted pairs could not be drawn through the reducing station at speeds exceeding the draw speed of the stranding machine.

As shown by the Figures, the tension reducing means are arranged in pairs, i.e. two for adjacent units 12. These two pairs are mounted together one on each side of a vertical framework 70, which is located at the downstream end of the units 12. Also mounted on the framework are two guide cylinders 72, one to each tension reducing means. These guide cylinders are freely rotatably mounted so as not to affect unduly the tensions in the twisted pairs and lie in positions below the cylinders 62. Each of the guide cylinders 72 is provided with twenty-five guide grooves 74 for accepting and maintaining apart the twenty-five twisted pairs of conductors. From its cylinder 72, each group of twenty-five twisted pairs of conductors moves forwardly into the stranding machine by passing round suitable guide rollers (not shown) for forming individual paths for the twisted pairs and for ensuring that their paths converge at the stranding head 16 for forming a core unit 75.

Figure 6:
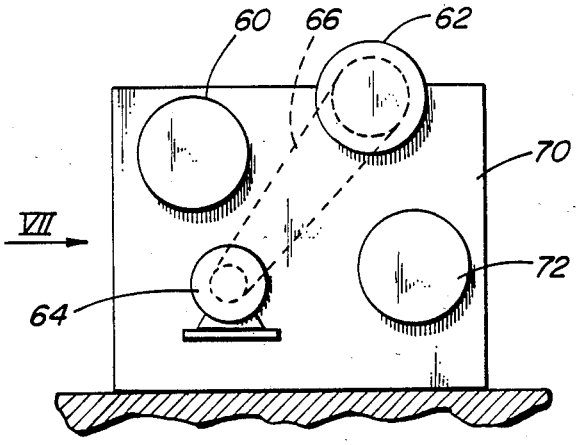
FIG. 6 is a side elevational view of a tension reducing means of the apparatus in the direction of arrow 'VI' in FIG. 1 but on a larger scale.
Figure 7:
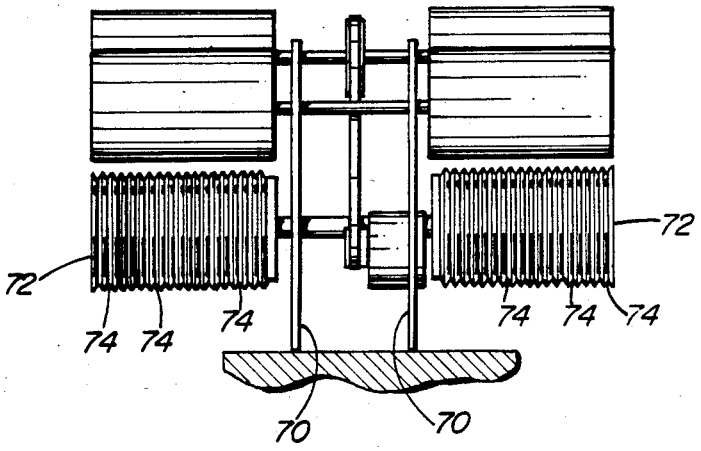
FIG. 7 is a view of the tension reducing means taken in the direction of arrow 'VII' in FIG. 6.

In use of the apparatus, each of the twisting machines is loaded with two reels 26 of individually insulated conductors as shown in FIG. 5. Upon start-up of the apparatus, the reel 17 is operated by the motor 16. Each of the motors 46 and 64 is driven at a speed controlled by the line speed such that the peripheral speeds of each of the driven cylinders 60 and 62 and each of the unrestrained tubular members 54 is in excess of the draw speed of the twisted pairs into the stranding machine as discussed above. Each of the twisted pairs 32 of conductors extends outwardly from its individual machine and along its own feedpath which takes it across and in contact with each of the tubular members 54 which lie in its path as it moves towards the stranding machine. Each of the conductors also passes around the cylinder 62, the cylinder 60 and then around its guide cylinder 72 as shown in FIG. 6.

During the twisting of the individual twisted pairs, there is tension in each of the conductors created by the pull of the stranding machine. This tension varies from one pair to another and is at least partly governed, in each case, by resistance to rotation of each reel 26 and flyer and the resistance offered by each guiding pulley or other surface with which a pair comes in contact. Tension in each twisted pair also depends upon its distance from the stranding machine. If these tension differences were still present when the twisted pairs reached the stranding machine, they would create differing tension conditions in the cable core which, undesirably, would lead to variations in the electrical characteristics and the finished core unit would be contorted along its length, which would render it difficult or impossible to further process the cable. The tension equalizing means overcomes this problem as will be described. In addition, the amounts of tension present in each twisted pair produced during twisting by this high speed apparatus operating at around 600 ft. per minute of core production may be around 3 lbs. Without the tension reducing effect of the tension reducing means, the accumulated tensions of up to one hundred pairs would be excessive and a conventional stranding machine would be incapable of drawing in this number of pairs with such a tensile resistive load. The tension equalizing and reducing means operate as follows.

As the twisted pairs pass across and are supported by the tubular members 54, they travel at different speeds dependent upon their positions and path lengths in the cable core being formed by the stranding machine. There is a tendency for the tubular members to urge the twisted pairs in the forward direction because of the faster driven peripheral speed of the members. However, with regard to each tubular member 54, because of the slipping driving engagement between the tubular members and their shafts 36, the upstream tensions in the twisted pairs and the effect of their relative speeds combine to slow down the speed of rotation of the tubular member to a speed which is influenced by these tensions and relative speeds of the pairs. At this speed of the members, the tensions in the pairs are changed from the upstream to the downstream side of each member with a greater reduction in tension in the more highly tensioned pairs than in less tensioned ones. There is an influence, therefore, towards equalizing the tensions in the pairs moving across each tubular member and this equalizing effect increases as the pairs move towards the final member 54. At each tubular member after the furthest upstream in any bank 12 of twisting machines, a twisted pair of conductors is brought directly from the adjacent twisting machine and over the member by guide pulleys such as pulleys 35 (FIG. 5). The tension in this twisted pair, which at this stage may be relatively high, is immediately affected and reduced by the tensions in the other pairs crossing the tubular member by the rotational speed of the member.

For each bank 12, the pairs of conductors with their relative tensions substantially closer than their upstream tensions, then approach and go through their tension reducing means. As the twisted pairs pass round the cylinders 60, 62 and 72 in the manner shown and proceed through the guides (not shown) to the stranding machine, the pull by the stranding machine increases the frictional contact of the twisted pairs against the surfaces of the cylinders 60 and 62. Although these cylinders are rotating at a peripheral speed which is greater than the throughput speed of the twisted pairs into the stranding machine, their degree of grip upon the pairs is insufficient to draw the pairs from the twisting machines at the peripheral speeds of the cylinders. The reason for this is explained above. Rather, the degree of drive by the cylinders is dependent upon the frictional grip upon them by the pairs which increases and decreases in proportion to the downstream tension created by the draw of the stranding machine. Hence, as already explained, the pull by the cylinders upon each pair increases its speed until it approaches that of the draw speed of that pair into the stranding machine sufficiently to reduce the frictional grip of the pair upon the cylinders to remove the driving force. Any slight increase in the downstream tension from the cylinders will improve their driving engagement with the pair thereby reducing the tension again. It follows that the tension in any twisted pair upstream of the cylinders (e.g. up to 3 lbs.) is reduced on the downstream side to an acceptable level (e.g. about 0.5 lbs.) for drawing into the stranding machine. It is stressed at this point that the driving force applied to each twisted pair is dependent upon the downstream tension in that pair. Hence, the cylinders 60 and 62 drive each twisted pair at any moment at its own individual speed irrespective of the speed of any of the other pairs. The speeds of the pairs must, of course, differ from one another because of the different path lengths they will occupy in the core unit. The operation of cylinders 60 and 62 thus conveniently allows for this. On the other hand, a conventional machine capstan which itself draws twisted pairs through a machine would be useless for the purpose. Capstan control would ensure that exactly equal lengths of twisted pairs would be fed into the stranding machine per unit of time. As the core unit needs different lengths of twisted pairs per unit length of core unit, some pairs would be at greater tensions than others, thus resulting in all the disadvantages which the present invention avoids. Thus, a conventional capstan would be incapable of solving the problem.

In the above apparatus, the tension equalizing means and the tension reducing means operate conveniently together. The finished core unit is free of any contorted shape thus showing that internal tension differences are minor and negligible. Also, electrical properties do not differ significantly along the finished cable and, in particular, mutual capacitance variations are extremely slight and are well within commercial acceptable limits.

What is claimed is:

1. Apparatus for making a core unit from twisted units of individually insulated conductors comprising:

a plurality of twisting machines each for carrying a plurality of reels of insulated conductor and for twisting the conductors together to form a twisted unit;

a core unit forming and take-up means in tandem with the twisting machines along feedpaths for the twisted units to draw the twisted conductor units together to form a core unit;

the forming and take-up means comprising drawing means to draw twisted units into the forming and take-up means; and a tension equalizing means comprising a series of rotatable means disposed along the feedpaths for the twisted units, one rotatable means associated with each twisting machine and disposed between its twisting machine and the forming and take-up means, and drive means controlled to drive each rotatable means, said drive means having a drive speed dependent upon the drive speed of the drawing means to ensure that the unrestrained peripheral speed of each rotatable means is in excess of the draw speed of the twisted units into the forming and take-up means, lengths of the peripheral surface of each rotatable means presented to the feedpaths being insufficient to impart a driven speed to the twisted units above that of the draw speed into the forming and take-up means.

2. Apparatus according to claim 1 wherein each rotatable means comprises a drivable shaft surrounded by a tubular member, which is in slipping driving engagement with the drivable shaft.

3. Apparatus according to claim 2 wherein the tubular member is carried by bearings upon the drivable shaft.

4. Apparatus according to claim 2 wherein the twisting machines are disposed in at least two straight line units of machines, the straight line units lying back-to-back and each having its individual tension equalizing means and tension reducing means.

5. A method of forming a core unit of twisted insulated conductor units comprising:

twisting insulated conductors together into a plurality of twisted insulated conductor units with each unit having a single direction of twist along its length;

drawing the twisted units as they are being formed through a core unit forming and take-up means to form the core unit;

and, as the twisted units approach the forming and take-up means, reducing differences in tension between the units by passing them side-by-side across and in contact with the peripheral surface of a rotating member which is in slipping driving engagement with a drivable shaft and the peripheral surface speed of the rotatable member is reduced to a speed dictated by a combination of tensions in all of the units upstream from the rotatable member.

* * * * *